US009989284B2

(12) United States Patent
Kawano et al.

(10) Patent No.: US 9,989,284 B2
(45) Date of Patent: Jun. 5, 2018

(54) REFRIGERATION APPARATUS

(71) Applicant: DAIKIN INDUSTRIES, LTD., Osaka-shi, Osaka (JP)

(72) Inventors: Satoshi Kawano, Sakai (JP); Shinya Matsuoka, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 706 days.

(21) Appl. No.: 14/402,080

(22) PCT Filed: May 8, 2013

(86) PCT No.: PCT/JP2013/062947
§ 371 (c)(1),
(2) Date: Nov. 18, 2014

(87) PCT Pub. No.: WO2013/175964
PCT Pub. Date: Nov. 28, 2013

(65) Prior Publication Data

US 2015/0128629 A1 May 14, 2015

(30) Foreign Application Priority Data

May 23, 2012 (JP) ..... 2012-117803

(51) Int. Cl.
*F25B 1/00* (2006.01)
*F25B 13/00* (2006.01)
(Continued)

(52) U.S. Cl.
CPC ..... *F25B 43/006* (2013.01); *F25B 9/002* (2013.01); *F25B 13/00* (2013.01); *F25B 31/004* (2013.01);
(Continued)

(58) Field of Classification Search
CPC ..... F25B 13/00; F25B 2313/02741; F25B 2500/16; F25B 31/004; F25B 43/006; F25B 49/02
(Continued)

(56) References Cited

U.S. PATENT DOCUMENTS 3,779,035 A * 12/1973 Kramer ..... F25B 43/006 62/503
5,134,859 A * 8/1992 Jaster ..... F25B 5/04 62/198
(Continued)

FOREIGN PATENT DOCUMENTS

EP 1 321 730 A2 6/2003
EP 1321730 A2 * 6/2003 ..... F25B 43/006
(Continued)

OTHER PUBLICATIONS

International Search Report of corresponding PCT Application No. PCT/JP2013/062947 dated Aug. 13, 2013.
(Continued)

*Primary Examiner* — Henry Crenshaw
(74) *Attorney, Agent, or Firm* — Global IP Counselors, LLP

(57) ABSTRACT

A refrigeration apparatus uses R32 as refrigerant, and includes a compressor, condenser, expansion mechanism, evaporator, accumulator, branching flow path, opening degree adjustment valve disposed in the branching flow path, injection-use heat exchanger and a first injection flow path. The accumulator has an inside space to separate and accumulate refrigerant. The injection-use heat exchanger causes heat exchange between refrigerant flowing through the main refrigerant flow path and that has passed through the opening degree adjustment valve of the branching flow path. The first injection flow path guides the refrigerant that has flowed through the branching flow path and exited the
(Continued)

injection-use heat exchanger to the inside space of the accumulator. A distal end of the first injection flow path is located in a height position separated by a dimension from a bottom of the inside space. The dimension is 0 to 0.3 times a height dimension of the inside space.

10 Claims, 5 Drawing Sheets

(51) Int. Cl.

| | |
|---|---|
| ***F25D 17/02*** | (2006.01) |
| ***F25B 43/00*** | (2006.01) |
| ***F25B 9/00*** | (2006.01) |
| ***F25B 49/02*** | (2006.01) |
| ***F25B 31/00*** | (2006.01) |

(52) U.S. Cl.
CPC ..... *F25B 49/02* (2013.01); *F25B 2313/006* (2013.01); *F25B 2313/0233* (2013.01); *F25B 2313/02741* (2013.01); *F25B 2400/13* (2013.01); *F25B 2500/16* (2013.01)

(58) Field of Classification Search
USPC .... 62/434, 503, 324.6, 228.1, 222, 160, 115
See application file for complete search history.

(56) References Cited

U.S. PATENT DOCUMENTS 5,136,855 A * 8/1992 Lenarduzzi ..... F24J 3/081 62/129
5,570,589 A * 11/1996 Petty ..... F25B 43/006 62/471
6,581,397 B1 6/2003 Taira et al.
2005/0103046 A1* 5/2005 Heyl ..... F25B 40/00 62/503
2006/0053832 A1* 3/2006 Ballet ..... F25B 13/00 62/503
2006/0236716 A1* 10/2006 Griffin ..... F25B 5/04 62/503
2007/0144207 A1* 6/2007 Klotten ..... F25B 43/006 62/503
2009/0044563 A1* 2/2009 Heckt ..... F25B 43/006 62/503

FOREIGN PATENT DOCUMENTS

| | | | | |
|---|---|---|---|---|
| EP | 2 434 236 | A2 | | 3/2012 |
| JP | 6-74613 | A | | 3/1994 |
| JP | 7-189908 | A | | 7/1995 |
| JP | 8-178476 | A | | 7/1996 |
| JP | 2001-227823 | A | | 8/2001 |
| JP | 2001227823 | A | * | 8/2001 |
| JP | 2002-147902 | A | | 5/2002 |
| JP | 2004-108715 | A | | 4/2004 |
| JP | 2004-263995 | A | | 9/2004 |
| JP | 2008-215697 | A | | 9/2008 |
| JP | 2008215697 | A | * | 9/2008 |
| JP | 2010-181090 | A | | 8/2010 |
| JP | 2010-255981 | A | | 11/2010 |

OTHER PUBLICATIONS

European Search Report of corresponding EP Application No. 13 79 3769.4 dated Mar. 15, 2016.
International Preliminary Report of corresponding PCT Application No. PCT/JP2013/062947 dated Dec. 4, 2014.

* cited by examiner

REFRIGERATION APPARATUS

CROSS-REFERENCE TO RELATED APPLICATIONS

This U.S. National stage application claims priority under 35 U.S.C. § 119(a) to Japanese Patent Application No. 2012-117803, filed in Japan on May 23, 2012, the entire contents of which are hereby incorporated herein by reference.

TECHNICAL FIELD

The present invention relates to a refrigeration apparatus and particularly a refrigeration apparatus that uses R32 as a refrigerant and is equipped with an accumulator.

BACKGROUND ART

Conventionally, refrigeration apparatuses such as air conditioning apparatuses have included refrigeration apparatuses that use R32 as a refrigerant. An air conditioning apparatus that uses a refrigerant such as R32 is described, for example, in JP-A No. 2004-263995. This air conditioning apparatus is equipped with a hot gas bypass circuit and an automatic opening and closing valve that divert some of hot gas discharged from a compressor and introduce it to an accumulator as a countermeasure in a case where refrigerating machine oil and liquid refrigerant have separated into two layers in the accumulator. Additionally, in accordance with a condition such as the temperature of the hot gas, the automatic opening and closing valve is opened to thereby guide the hot gas to the bottom portion of the accumulator, so that the liquid refrigerant and the refrigerating machine oil that have separated into two layers are agitated and the refrigerating machine oil is retuned to the compressor from the accumulator.

SUMMARY

Technical Problem

As described above, the air conditioning apparatus of JP-A No. 2004-263995 is disposed with the hot gas bypass circuit and the automatic opening and closing valve for guiding the hot gas to the bottom portion of the accumulator, but because some of the hot gas is bypassed to the accumulator during the heating operation, for example, sometimes the quantity of the hot gas flowing to the condenser decreases and there is a large drop in capacity.

It is an object of the present invention to appropriately eliminate, without using hot gas, the separation of liquid refrigerant and refrigerating machine oil into two layers inside an accumulator in a refrigeration apparatus that uses R32 as a refrigerant and is equipped with the accumulator.

Solution to Problem

A refrigeration apparatus pertaining to a first aspect of the present invention is a refrigeration apparatus that uses R32 as a refrigerant, and is equipped with a compressor, a condenser, an expansion mechanism, an evaporator, an accumulator, a branching flow path, an opening degree adjustment valve, an injection-use heat exchanger, and a first injection flow path. The compressor sucks in the refrigerant from a suction flow path and compresses the refrigerant. The condenser condenses the refrigerant that has been discharged from the compressor. The expansion mechanism expands the refrigerant that has exited the condenser. The evaporator evaporates the refrigerant that has expanded in the expansion mechanism. The accumulator is disposed in the suction flow path, has formed therein an inside space for separating the refrigerant that has exited the evaporator into gas refrigerant and liquid refrigerant and accumulating surplus refrigerant, and sends the separated gas refrigerant to the compressor. The branching flow path branches from a main refrigerant flow path that interconnects the condenser and the evaporator. The opening degree adjustment valve is disposed in the branching flow path and its opening degree can be adjusted. The injection-use heat exchanger causes the refrigerant flowing through the main refrigerant flow path and the refrigerant that has passed through the opening degree adjustment valve of the branching flow path to exchange heat. The first injection flow path is a flow path that guides the refrigerant that has flowed through the branching flow path and exited the injection-use heat exchanger to the inside space of the accumulator. A distal end of the first injection flow path is located in a height position separated by a dimension of 0 to 0.3 times the height dimension of the inside space of the accumulator from a bottom of the inside space of the accumulator.

In this refrigeration apparatus that uses R32 as the refrigerant, the accumulator that has the function of accumulating surplus refrigerant is disposed in the suction flow path, so at the time of a low temperature condition, it may be assumed that the liquid refrigerant and the refrigerating machine oil will separate into two layers in the inside space of the accumulator. However, the refrigeration apparatus is configured in such a way that the refrigerant flowing through the branching flow path that branches from the main refrigerant flow path is guided via the injection-use heat exchanger from the first injection flow path to the inside space of the accumulator, and the distal end of the first injection flow path is disposed in a height position near the bottom of the inside space of the accumulator, so the liquid refrigerant and the refrigerating machine oil that accumulate in the inside space of the accumulator can be agitated by the refrigerant entering the accumulator from the first injection flow path. Because of this, the separation phenomenon can be controlled by the agitation even when it seems likely that the liquid refrigerant and the refrigerating machine oil will separate into two layers in the inside space of the accumulator.

A refrigeration apparatus pertaining to a second aspect of the present invention is the refrigeration apparatus pertaining to the first aspect, and is further equipped with a second injection flow path and a switching mechanism. The second injection flow path guides the refrigerant that has flowed through the branching flow path and exited the injection-use heat exchanger to the suction flow path positioned between the accumulator and the compressor. The switching mechanism switches between a first state and a second state. The first state is a state in which the refrigerant that has flowed through the branching flow path and exited the injection-use heat exchanger flows into the inside space of the accumulator. The second state is a state in which the refrigerant that has flowed through the branching flow path and exited the injection-use heat exchanger flows into the suction flow path positioned between the accumulator and the compressor.

Here, the second injection flow path is disposed in addition to the first injection flow path, and the switching mechanism switches between which of the injection flow paths to use to return the refrigerant that has exited the injection-use heat exchanger to the suction flow path on the suction side of the compressor. For this reason, when it seems likely that the liquid refrigerant and the refrigerating machine oil will separate into two layers in the inside space of the accumulator, the first injection flow path is used to return the refrigerant to the compressor via the accumulator and the suction flow path, and when it does not seem likely that the liquid refrigerant and the refrigerating machine oil will separate into two layers in the inside space of the accumulator, the second injection flow path is used to return the refrigerant to the compressor via the suction flow path, and thus it becomes possible to control foaming in the inside space of the accumulator. Furthermore, at the time of a situation where the discharge temperature of the compressor has exceeded an upper limit value and reached a high temperature, the second injection flow path, and not the first injection flow path, is used to directly flow the refrigerant from the injection-use heat exchanger to the suction flow path near the compressor, and thus it also becomes possible to obtain early on the effect of cooling the compressor.

A refrigeration apparatus pertaining to a third aspect of the present invention is the refrigeration apparatus according to the second aspect, and is further equipped with a control unit. When the outside air temperature is equal to or lower than a threshold value, the control unit performs first control that switches the switching mechanism to the first state. Furthermore, in a case where the outside air temperature exceeds the threshold value, the control unit performs second control that switches the switching mechanism to the second state.

Here, when the outside air temperature is equal to or lower than the threshold value, the potential for the liquid refrigerant and the refrigerating machine oil to separate into two layers in the inside space of the accumulator is high, so the control unit performs the first control that switches the switching mechanism to the first state to thereby agitate the liquid refrigerant and the refrigerating machine oil that accumulate in the inside space of the accumulator. On the other hand, in a case where the outside air temperature exceeds the threshold value, it is not necessary to agitate the inside space of the accumulator and it is preferable to prevent the occurrence of foaming and use the injection-use heat exchanger to cool the refrigerant flowing through the main refrigerant flow path, so the control unit performs the second control that switches the switching mechanism to the second state.

A refrigeration apparatus pertaining to a fourth aspect of the present invention is the refrigeration apparatus pertaining to any of the first to third aspects, wherein a refrigerant outlet in the distal end of the first injection flow path faces a direction along an inside surface of the accumulator.

Here, the refrigerant entering the inside space of the accumulator from the first injection flow path flows along the inside surface of the accumulator, so even if foaming occurs in the inside space of the accumulator, it is kept relatively small.

A refrigeration apparatus pertaining to a fifth aspect of the present invention is the refrigeration apparatus pertaining to any of the first to fourth aspects, wherein a refrigerant outlet in the distal end of the first injection flow path faces upward or diagonally upward.

Here, the refrigerant entering the inside space of the accumulator from the first injection flow path has an upward vector, so it becomes difficult tier the liquid refrigerant and the refrigerant machine oil in the inside space of the accumulator that try to separate into two vertical layers to separate. That is, the refrigerant entering the inside space of the accumulator creates a vertical flow in the inside space of the accumulator, so it becomes even more difficult for two layer separation between the liquid refrigerant and the refrigerating machine oil to occur even at a low temperature.

A refrigeration apparatus pertaining to a sixth aspect of the present invention is the refrigeration apparatus pertaining to any of the first to fifth aspects, wherein the accumulator has a casing that forms the inside space, an inlet pipe for introducing the refrigerant that has evaporated in the evaporator to the inside space, and an outlet pipe for channeling the separated gas refrigerant to the compressor. The casing includes a tubular body whose top and bottom are open, an upper cover that closes off the opening in the top of the tubular body, and a lower cover that closes off the opening in the bottom of the tubular body, Additionally, the height position of the distal end of the first injection flow path is lower than the height position of an upper end of the lower cover.

Here, the distal end of the first injection flow path is positioned in a place lower than the height position of the upper end of the lower cover among the parts configuring the casing, so the liquid refrigerant and the refrigerating machine oil that accumulate in the inside space of the accumulator can be effectively agitated.

Advantageous Effects of Invention

According to the refrigeration apparatus pertaining to the first aspect of the present invention, the distal end of the first injection flow path is disposed in a height position near the bottom of the inside space of the accumulator, so the liquid refrigerant and the refrigerating machine oil that accumulate in the inside space of the accumulator can be agitated by the refrigerant entering the accumulator from the first injection flow path.

According to the refrigeration apparatus pertaining to the second aspect of the present invention, when it seems likely that the liquid refrigerant and the refrigerating machine oil will separate into two layers in the inside space of the accumulator, the first injection flow path is used to return the refrigerant to the compressor via the accumulator and the suction flow path, and when it does not seem likely that the liquid refrigerant and the refrigerating machine oil will separate into two layers in the inside space of the accumulator, the second injection flow path is used to return the refrigerant to the compressor via the suction flow path, and thus foaming in the inside space of the accumulator can be controlled.

According to the refrigeration apparatus pertaining to the third aspect of the present invention, when the potential for the liquid refrigerant and the refrigerating machine oil to separate into two layers in the inside space of the accumulator is high, the control unit performs the first control so that the inside of the accumulator can be agitated, and when there is no need for such agitation, the control unit performs the second control so that the occurrence of foaming can be prevented and the refrigerant flowing through the main refrigerant flow path can be cooled by the injection-use heat exchanger.

According to the refrigeration apparatus pertaining to the fourth aspect of the present invention, foaming inside the accumulator is kept small.

According to the refrigeration apparatus pertaining to the fifth aspect of the present invention, the refrigerant entering the inside space of the accumulator creates a vertical flow in the inside space of the accumulator, so it becomes even more difficult for two layer separation between the liquid refrigerant and the refrigerating machine oil to occur even at a low temperature.

According to the refrigeration apparatus pertaining to the sixth aspect of the present invention, the liquid refrigerant and the refrigerating machine oil that accumulate in the inside space of the accumulator can be agitated more effectively.

BRIEF DESCRIPTION OF DRAWINGS

DESCRIPTION OF EMBODIMENT (1) Overall Configuration of Air Conditioning Apparatus FIG. 1 is a drawing showing a refrigerant pipe system of an air conditioning apparatus 10 that is a refrigeration apparatus pertaining to an embodiment of the present invention. The air conditioning apparatus 10 is a distributed air conditioning apparatus with a refrigerant pipe system and heats and cools rooms in a building by performing a vapor compression refrigeration cycle operation. The air conditioning apparatus 10 is equipped with an outdoor unit 11 serving as a heat source unit, numerous indoor units 12 serving as utilization units, and a liquid refrigerant connection pipe 13 and a gas refrigerant connection pipe 14 serving as refrigerant connection pipes interconnecting the outdoor unit 11 and the indoor units 12. That is, a refrigerant circuit of the air conditioning apparatus 10 shown in FIG. 1 is configured as a result of the outdoor unit 11, the indoor units 12, and the refrigerant connection pipes 13 and 14 being connected, Additionally, refrigerant is sealed inside the refrigerant circuit shown in FIG. 1, and as described later, a refrigeration cycle operation is performed wherein the refrigerant is compressed, cooled and condensed, reduced in pressure, heated and evaporated, and thereafter compressed again. As the refrigerant, R32 is used. R32 is a low-GWP refrigerant whose global warming potential is low, and is a type of HFC refrigerant. Furthermore, as refrigerating machine oil, an ether-based synthetic oil having some compatibility with R32 is used. Because the air conditioning apparatus 10 uses R32 as the refrigerant, although it also depends on the percentage of the oil component, in a low temperature condition (e.g., 0° C. or lower) the solubility of the refrigerating machine oil sealed together with the refrigerant in order to lubricate a compressor 20 tends to become extremely low.

Figure 1:
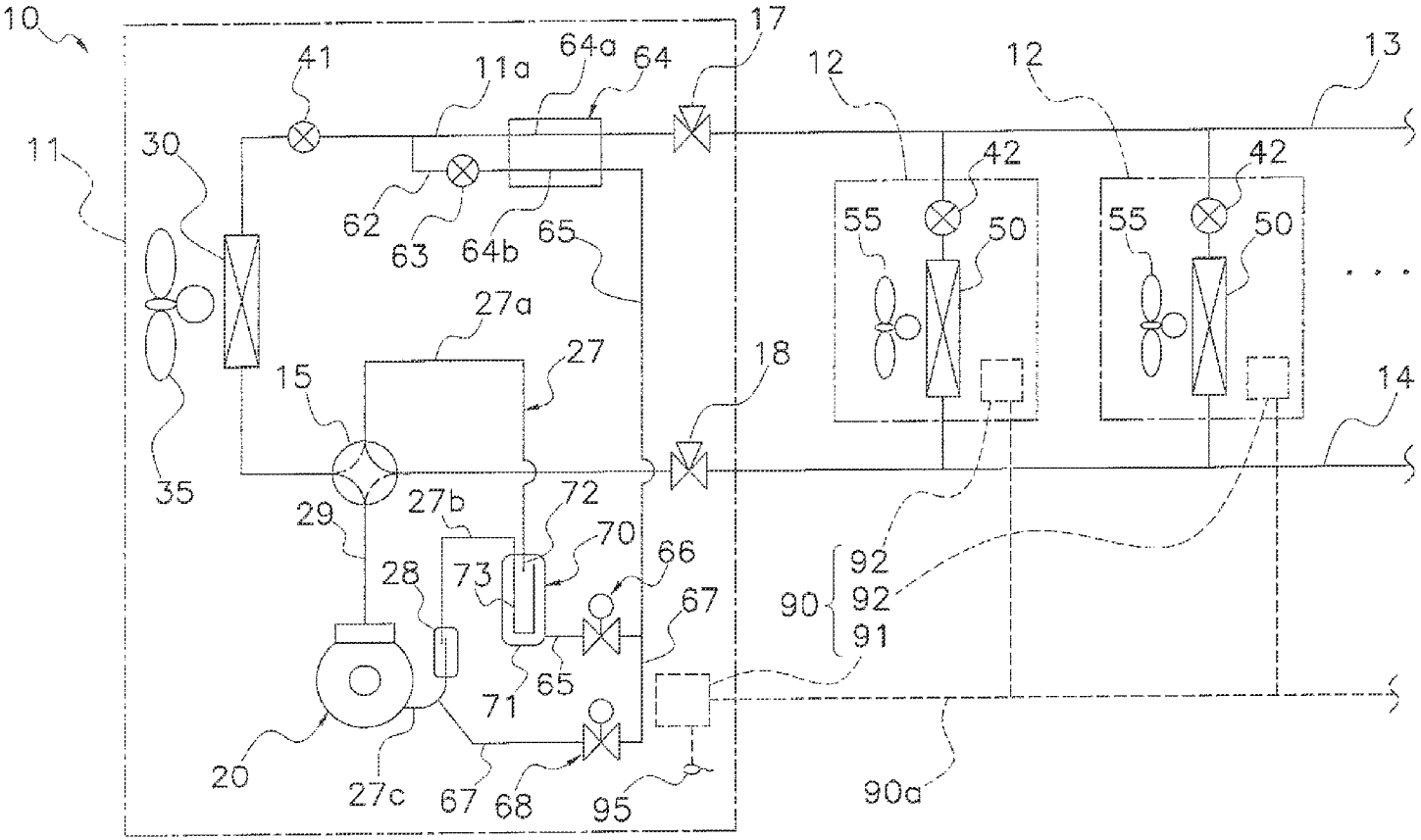
FIG. 1 is a drawing showing a refrigerant pipe system of an air conditioning apparatus pertaining to an embodiment of the present invention.

(2) Detailed Configuration of Air Conditioning Apparatus (2-1) Indoor Units

The indoor units 12 are installed on ceilings or side walls of the rooms and are connected to the outdoor unit 11 via the refrigerant connection pipes 13 and 14. The indoor units 12 mainly have indoor expansion valves 42 that are pressure reducers and indoor heat exchangers 50 serving as utilization-side heat exchangers.

The indoor expansion valves 42 are expansion mechanisms for reducing the pressure of the refrigerant and are electrically powered valves whose opening degree can be adjusted. The indoor expansion valves 42 each have one end connected to the liquid refrigerant connection pipe 13 and the other end connected to the indoor heat exchangers 50.

The indoor heat exchangers 50 are heat exchangers that function as evaporators or condensers of the refrigerant. The indoor heat exchangers 50 each have one end connected to the indoor expansion valves 42 and the other end connected to the gas refrigerant connection pipe 14.

The indoor units 12 are equipped with indoor fans 55 for sucking room air into the units and supplying the air back to the rooms, and cause the room air and the refrigerant flowing through the indoor heat exchangers 50 to exchange heat.

Furthermore, the indoor units 12 each have various sensors and an indoor control unit 92 that controls the actions of each part configuring the indoor units 12. The indoor control units 92 each have a microcomputer and a memory disposed in order to control the indoor units 12, and the indoor control units 92 exchange control signals and so forth with remote controllers (not shown in the drawings) for individually operating the indoor units 12 and exchange control signals and so forth via a transmission line 90*a* with an outdoor control unit 91 of the outdoor unit 11 described later.

(2-2) Outdoor Unit

The outdoor unit 11 is installed outside the building or in the basement of the building in which the rooms equipped with the indoor units 12 exist, and the outdoor unit 11 is connected to the indoor units 12 via the refrigerant connection pipes 13 and 14. The outdoor unit 11 mainly has a compressor 20, a four-way switching valve 15, an outdoor heat exchanger 30, an outdoor expansion valve 41, an injection-use electrically powered valve 63, an injection-use heat exchanger 64, a liquid-side stop valve 17, a gas-side stop valve 18, and an accumulator 70.

The compressor 20 is a closed compressor driven by a compressor motor. In the present embodiment, there is just one compressor 20, but the compressor 20 is not limited to this and two or more compressors may also be connected in parallel depending, for example, on the number of the indoor units 12 that are connected. The compressor 20 sucks in gas refrigerant via a compressor-attached container 28.

The four-way switching valve 15 is a mechanism for switching the direction of the flow of the refrigerant. During the cooling operation, the four-way switching valve 15 interconnects a refrigerant pipe 29 on the discharge side of the compressor 20 and one end of the outdoor heat exchanger 30 and also interconnects a suction flow path 27 (including the accumulator 70) on the suction side of the compressor 20 and the gas-side stop valve 18 in order to cause the outdoor heat exchanger 30 to function as a condenser of the refrigerant that is compressed by the compressor 20 and cause the indoor heat exchangers 50 to function as evaporators of the refrigerant that has been cooled in the outdoor heat exchanger 30 (see the solid lines of the four-way switching valve 15 in FIG. 1). Furthermore, during the heating operation, the four-way switching valve 15 interconnects the refrigerant pipe 29 on the discharge side of the compressor 20 and the gas-side stop valve 18 and also interconnects the suction flow path 27 and the one end of the outdoor heat exchanger 30 in order to cause the indoor heat exchangers 50 to function as condensers of the refrigerant that is compressed by the compressor 20 and cause the outdoor heat exchanger 30 to function as an evaporator of the refrigerant that has been cooled in the indoor heat exchangers 50 (see the dashed lines of the four-way switching valve 15 in FIG. 1). In the present embodiment, the four-way switching valve 15 is a four-way switching valve connected to the suction flow path 27, the refrigerant pipe 29 on the discharge side of the compressor 20, the outdoor heat exchanger 30, and the gas-side stop valve 18.

The outdoor heat exchanger 30 is a heat exchanger that functions as a condenser or evaporator of the refrigerant. The outdoor heat exchanger 30 has the one end connected to the four-way switching valve 15 and the other end connected to the outdoor expansion valve 41.

The outdoor unit 11 has an outdoor an 35 for sucking outdoor air into the unit and expelling the air back outdoors. The outdoor fan 35 causes the outdoor air and the refrigerant flowing through the outdoor heat exchanger 30 to exchange heat and is driven to rotate by an outdoor fan motor. The heat source of the outdoor heat exchanger 30 is not limited to outdoor air and may also be another heat medium such as water.

The outdoor expansion valve 41 is an expansion mechanism for reducing the pressure of the refrigerant and is an electrically powered valve whose opening degree can be adjusted. The outdoor expansion valve 41 has one end connected to the outdoor heat exchanger 30 and the other end connected to the injection-use heat exchanger 64. A branching pipe 62 branches from one section of a main refrigerant flow path 11*a* interconnecting the outdoor expansion valve 41 and the injection-use heat exchanger 64. The main refrigerant flow path 11*a* is a main flow path for liquid refrigerant interconnecting the outdoor heat exchanger 30 and the indoor heat exchangers 50.

The injection-use expansion valve 63, whose opening degree can be adjusted, is disposed in the branching pipe 62. Furthermore, the branching pipe 62 is connected to a second flow path 64*b* of the injection-use heat exchanger 64. That is, refrigerant that has been diverted from the main refrigerant flow path 11*a* to the branching pipe 62 has its pressure reduced by the injection-use expansion valve 63 and flows to the second flow path 64*b* of the injection-use heat exchanger 64.

The refrigerant that has had its pressure reduced by the injection-use expansion valve 63 and flowed to the second flow path 64*b* of the injection-use heat exchanger 64 exchanges heat with the refrigerant flowing through a first flow path 64*a* of the injection-use heat exchanger 64. The first flow path 64*a* of the injection-use heat exchanger 64 configures part of the mainrefrigerant flow path 11*a*. The refrigerant that has flowed through the branching pipe 62 and the second flow path 64*b* after exchanging heat in the injection-use heat exchanger 64 is sent by a first injection flow path 65 toward the accumulator 70.

The injection-use heat exchanger 64 is an internal heat exchanger employing a dual pipe structure and, as mentioned above, causes the refrigerant flowing through the main refrigerant flow path 11*a* that is the main flow path and the refrigerant that has been diverted from the main refrigerant flow path 11*a* for injection to exchange heat. One end of the first flow path 64*a* of the injection-use heat exchanger 64 is connected to the outdoor expansion valve 41, and the other end is connected to the liquid-side stop valve 17.

The liquid-side stop valve 17 is a valve to which is connected the liquid refrigerant connection pipe 13 for exchanging the refrigerant between the outdoor unit 11 and the indoor units 12. The gas-side stop valve 18 is a valve to which is connected the gas refrigerant connection pipe 14 for exchanging the refrigerant between the outdoor unit 11 and the indoor units 12, and the gas-side stop valve 18 is connected to the four-way switching valve 15. Here, the liquid-side stop valve 17 and the gas-side stop valve 18 are three-way valves equipped with service ports.

Figure 2:
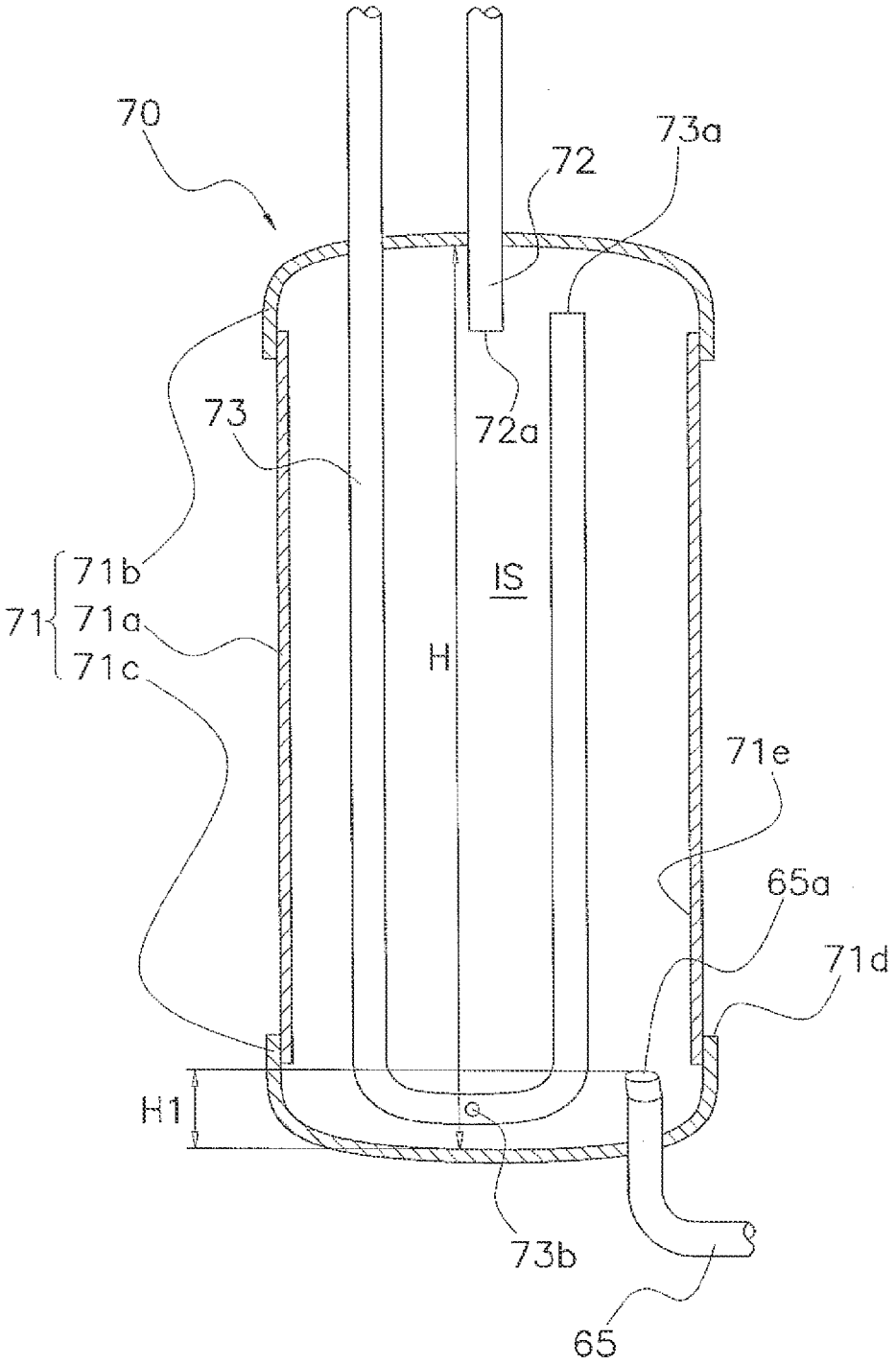
FIG. 2 is a schematic configuration drawing of an accumulator.

The accumulator 70 is disposed in the suction flow path 27 between the four-way switching valve 15 and the compressor 20 and separates, into gas refrigerant and liquid refrigerant, the refrigerant that has returned through a first pipe 27*a* of the suction flow path 27 connected to the four-way switching valve 15 from the indoor heat exchangers 50 or the outdoor heat exchanger 30 functioning as an evaporator. Of the refrigerant that has been separated into gas refrigerant and liquid refrigerant, the gas refrigerant is sent to the compressor 20. As shown in FIG. 1 and FIG. 2, the accumulator 70 has a casing 71 that forms an inside space IS, an inlet pipe 72, and an outlet pipe 73. The casing 71 is mainly configured from a cylindrical body 71*a* whose top and bottom are open, a bowl-shape upper cover 71*b* that closes off the opening in the top of the body 71*a*, and a bowl-shaped lower cover 71*c* that closes off the opening in the bottom of the body 71*a*. The inlet pipe 72 introduces the refrigerant that has traveled through the first, pipe 27*a* of the suction flow path 27 into the inside space IS. The inlet pipe 72 penetrates the upper cover 71*b*, and the height position of an inflow opening 72*a* in the lower end (distal end) of the inlet pipe 72 is positioned in the upper portion of the inside space IS. The outlet pipe 73 sends the gas refrigerant that has separated in the inside space IS to a second pipe 27*b* of the suction flow path 27 connected to the compressor-attached container 28. The outlet pipe 73 is a J-shaped pipe, penetrates the upper cover 71*b*, and makes a U-turn in the lower portion of the inside space IS, and the height position of an outflow opening 73*a* in the upper end (distal end) of the outlet pipe 73 is positioned in the upper portion of the inside space IS. An oil return hole 73*b* is formed in the U-turn section of the outlet pipe 73 in the lower portion of the inside space IS. The oil return hole 73*b* is a hole for returning to the compressor 20 the refrigerating machine oil accumulating together with the liquid refrigerant in the lower portion of the inside space IS of the casing 71.

Furthermore, the inside space IS of the accumulator 70 is communicated with the first injection flow path 65 via a distal end opening 65*a* in the first injection flow path 65. That is, the refrigerant flows into the inside space IS of the accumulator 70 from the first injection flow path 65. As described above, the first injection flow path 65 is a flow path that supplies, to the inside space IS of the accumulator 70, the refrigerant that has been diverted from the main refrigerant flow path 11*a* and traveled through the injection-use heat exchanger 64. The distal end section of the first injection flow path 65 penetrates the lower cover 71*c* of the accumulator 70 from below to above, and the distal end opening 65*a* therein is positioned in the lower portion of the inside space IS of the accumulator 70. The height position of the distal end opening 65*a* in the first injection flow path 65 is lower than the height position of an upper end 71*d* of the lower cover 71*c* (see FIG. 2). Furthermore, the distal end opening 65*a* in the first injection flow path 65 is located in a position separated by a height dimension Hi from the bottom of the inside space IS of the accumulator 70. The height dimension H1 is 0 to 0.3 times a height dimension H of the inside space IS of the accumulator 70. In what is shown in FIG. 2, the height dimension H1 is equal to or less than ⅕ of the height dimension H. The distal end opening 65*a* in the first injection flow path 65 generally faces upward, but specifically faces diagonally upward. The distal end section of the first injection flow path 65 penetrates the peripheral edge portion of the lower cover 71*c* of the accumulator 70, and the distal end opening 65*a* in the first injection flow path 65 faces a direction along an inside surface 71*e* of the accumulator 70.

The outlet pipe 73 of the accumulator 70 and the compressor-attached container 28 are interconnected by the second pipe 27*b* of the suction flow path 27, and the compressor-attached container 28 and the compressor 20 are interconnected by a third pipe 27*c* of the suction flow path 27.

As shown in FIG. 1, a second injection flow path 67 is connected to the third pipe 27*c* of the suction flow path 27. The second injection flow path 67 is a flow path for supplying, to the third pipe 27*c* connected to the suction portion of the compressor 20, the refrigerant that has been diverted from the main refrigerant flow path 11*a* and traveled through the injection-use heat exchanger 64. Furthermore, the second injection flow path 67 is a flow path that branches from the first injection flow path 65 extending from the injection-use heat exchanger 64. Between that branching point and the accumulator 70, a first opening and closing valve 66 is disposed in the first injection flow path 65. Furthermore, a second opening and closing valve 68 is disposed in the second injection flow path 67. As described later, the first opening and closing valve 66 and the second opening and closing valve 68 function as switching mechanisms that switch between a first state in which the refrigerant is supplied by the first injection flow path 65 to the accumulator 70 and a second state in which the refrigerant is supplied by the second injection flow path 67 to the third pipe 27*c* connected to the suction portion of the compressor 20.

Instead of disposing the first opening and closing valve 66 in the first injection flow path 65 and the second opening and closing valve 68 in the second injection flow path 67, a three-way valve may also be disposed in the branching point between the first injection flow path 65 and the second injection flow path 67. With this three-way valve also, it is possible to switch between the first state and the second state.

Furthermore, the outdoor unit 11 has various sensors, including an outside air temperature sensor 95 that detects the outside air temperature, and an outdoor control unit 91. The outdoor control unit 91 has a microcomputer and a memory disposed in order to control the outdoor unit 11 and exchanges control signals and so forth via a transmission line 8*a* with the indoor control units 92 of the indoor units 12. A control unit 90 of the air conditioning apparatus 10 is configured by the outdoor control unit 91 and the indoor control units 92.

(2-3) Refrigerant Connection Pipes

The refrigerant connection pipes 13 and 14 are refrigerant pipes installed on site when installing the outdoor unit 111 and the indoor units 12 in an installation location.

(2-4) Control Unit

The control unit 90 serving as control means that controls the various operations of the air conditioning apparatus 10 is, as shown in FIG. 1, configured by the outdoor control unit 91 and the indoor control units 92 interconnected via the transmission line 90*a*. The control unit 90 receives detection signals from the various sensors and controls the various devices on the basis of these detection signals and so forth.

The control unit 90 has, as functional units, a test operation control unit for test operations and a normal operation control unit for controlling normal operations such as the cooling operation, and the control unit 90 also performs injection control during the control of each operation.

(3) Actions of Air Conditioning Apparatus

Next, the actions of the air conditioning apparatus 10 pertaining to the present embodiment will be described. Control during each operation described below is performed by the control unit 90 functioning as operation control means.

(3-1) Basic Actions during Cooling Operation

During the cooling operation, the four-way switching valve 15 switches to the state indicated by the solid lines in FIG. 1, that is, a state where the gas refrigerant discharged from the compressor 20 flows to the outdoor heat exchanger 30 and where the suction flow path 27 is connected to the gas-side stop valve 18. The outdoor expansion valve 41 is completely open and the indoor expansion valves 42 have their opening degrees adjusted. The stop valves 17 and 18 are open.

In this state of the refrigerant circuit, the high-pressure gas refrigerant that has been discharged from the compressor 20 is sent through the four-way switching valve 15 to the outdoor heat exchanger 30 functioning as a condenser of the refrigerant, exchanges heat with the outdoor air supplied by the outdoor fan 35, and is cooled. The high-pressure refrigerant that has been cooled and liquefied in the outdoor heat exchanger 30 becomes subcooled in the injection-use heat exchanger 64 and is sent through the liquid refrigerant connection pipe 13 to each of the indoor units 12. The refrigerant that has been sent to each of the indoor units 12 has its pressure reduced by the indoor expansion valves 42, becomes low-pressure refrigerant in a gas-liquid two-phase state, exchanges heat with the room air in the indoor heat exchangers 50 functioning as evaporators of the refrigerant, evaporates, and becomes low-pressure gas refrigerant, Then, the low-pressure gas refrigerant that has been heated in the indoor heat exchangers 50 is sent through the gas refrigerant connection pipe 14 to the outdoor unit 11, travels through the four-way switching valve 15 and the accumulator 70, and is sucked back into the compressor 20, In this way, cooling of the rooms is performed.

In a case where just some indoor units of the indoor units 12 are being operated, the indoor expansion valves 42 of the indoor units that are stopped are set to a stopped opening degree (e.g., completely dosed). In this case, virtually no refrigerant passes through the indoor units 12 that are stopped, so that the cooling operation is performed only in the indoor units 12 that are in operation.

(3-2) Basic Actions during Heating Operation

During the heating operation, the four-way switching valve 15 switches to the state indicated by the dashed lines in HG 1, that is, a state where the refrigerant pipe 29 on the discharge side of the compressor 20 is connected to the gas-side stop valve 18 and where the suction flow path 27 is connected to the outdoor heat exchanger 30. The outdoor expansion valve 41 and the indoor expansion valves 42 have their opening degrees adjusted. The stop valves 17 and 18 are open.

In this state of the refrigerant circuit, the high-pressure gas refrigerant that has been discharged from the compressor 20 is sent through the four-way switching valve 15 and the gas refrigerant connection pipe 14 to each of the indoor units 12, Then, the high-pressure gas refrigerant that has been sent to each of the indoor units 12 exchanges heat with the room air and is cooled in the indoor heat exchangers 50 functioning as condensers of the refrigerant, thereafter travels through the indoor expansion valves 42, and is sent through the liquid refrigerant connection pipe 13 to the outdoor unit 11.

When the refrigerant exchanges heat with the room air and is cooled, the room air is heated. The high-pressure refrigerant that has been sent to the outdoor unit 11 becomes subcooled in the injection-use heat exchanger 64, has its pressure reduced by the outdoor expansion valve 41, becomes low-pressure refrigerant in a gas-liquid two-phase state, and flows into the outdoor heat exchanger 30 functioning as an evaporator of the refrigerant. The low-pressure refrigerant in the gas-liquid two-phase state that has flowed into the outdoor heat exchanger 30 exchanges heat with the outdoor air supplied by the outdoor fan 35, is heated, evaporates, and becomes low-pressure refrigerant. The low-pressure gas refrigerant that has exited the outdoor heat exchanger 30 travels through the four-way switching valve 15 and the accumulator 70 and is sucked back into the compressor 20. In this way, heating of the rooms is performed.

Surplus refrigerant is accumulated in the accumulator 70 particularly during the heating operation.

(3-3) Injection Control in Each Operation

Figure 3:
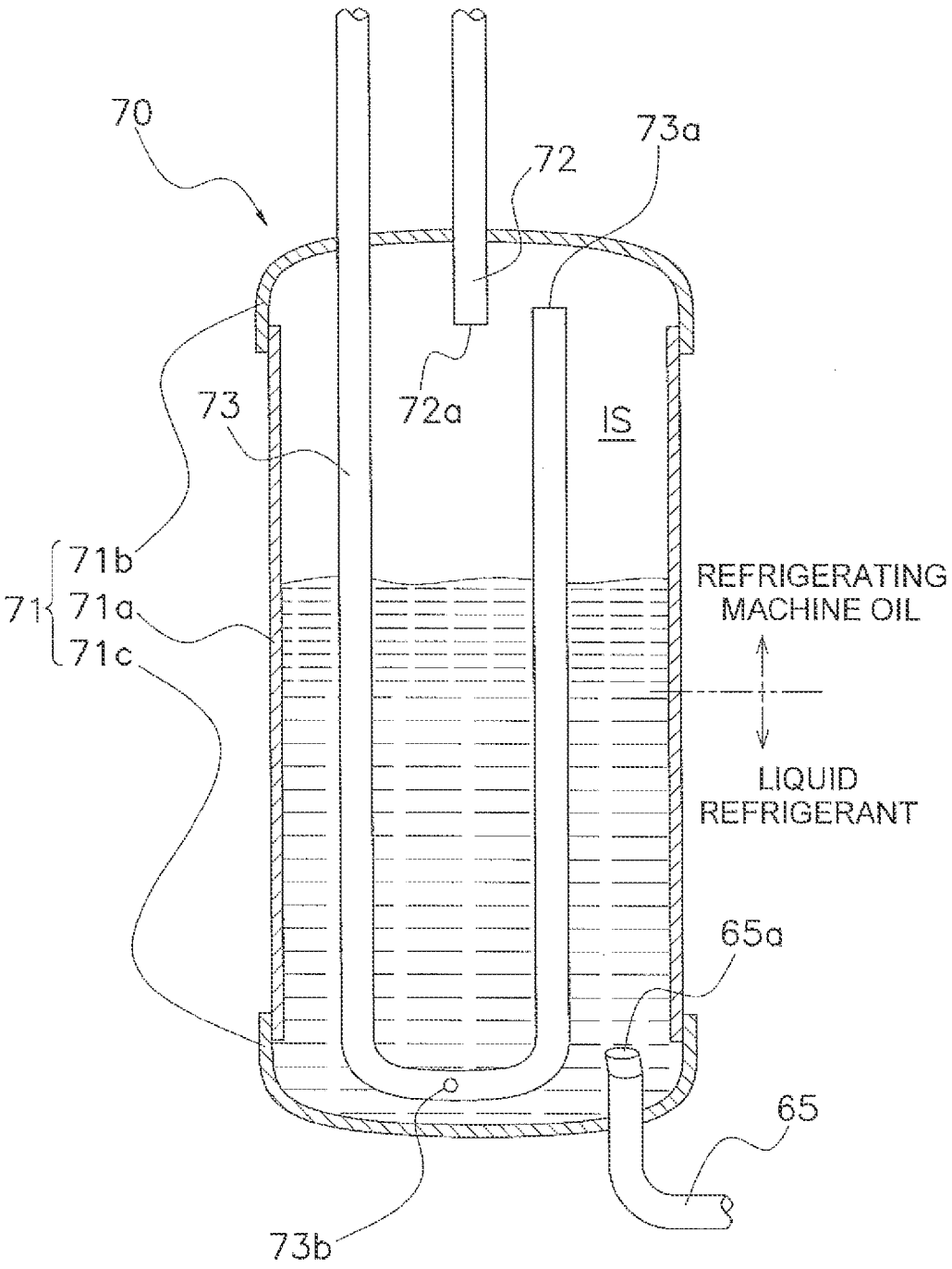
FIG. 3 is a drawing showing the accumulator, with liquid refrigerant and refrigerating machine oil having separated into two layers in an inside space.

As described above, the air conditioning apparatus 10 uses R32 as the refrigerant, so in a low temperature condition (e.g., where the temperature of the refrigerant is 0° C. or lower), the solubility of the refrigerating machine oil sealed together with the refrigerant in order to lubricate the compressor 20 becomes extremely low. For this reason, when the low pressure in the refrigeration cycle is reached, the solubility of the refrigerating machine oil drops greatly because of the drop in the temperature of the refrigerant, so that the R32 that is the refrigerant and the refrigerating machine oil separate into two layers inside the accumulator 70 at which the low pressure is reached in the refrigeration cycle, and it becomes difficult for the refrigerating machine oil to return to the compressor 20. In particular, during the heating operation and at the start of the heating operation when a large amount of surplus refrigerant tends to accumulate, as shown in FIG. 3, there is a tendency for the lower portion of the inside space IS of the casing 71 to be filled with the liquid refrigerant and for the refrigerating machine oil that has separated from the liquid refrigerant to collect in the upper portion of the inside space IS. When this kind of two layer separation occurs, the oil return hole 73*b* in the outlet pipe 73 of the accumulator 70 and the refrigerating machine oil end up being away from one another, so that the refrigerating machine oil accumulating in the inside space IS of the accumulator 70 becomes unable to be returned to the compressor 20.

In light of this, in the air conditioning apparatus 10, the control unit 90 performs first control using the first injection flow path 65 at the time of a condition where the temperature of the refrigerant drops and specifically when the outside air temperature is equal to or lower than a threshold value. In this first control, the control unit 90 opens the first opening and closing valve 66 of the first injection flow path 65, closes the second opening and closing valve 68 of the second injection flow path 67, and adjusts the opening degree of the injection-use electrically powered valve 63 to inject, into the inside space IS of the accumulator 70, the refrigerant that has been diverted from the main refrigerant flow path 11*a* and traveled through the injection-use heat exchanger 64. Because of this, as shown in FIG. .4, the liquid refrigerant and refrigerating machine oil accumulating in the inside space IS of the accumulator 70 are agitated in such a way as to create a vertical flow (see the thick arrows in FIG. 4) so that the two layer separation phenomenon inside the accumulator 70 is eliminated or controlled.

On the other hand, the control unit 90 of the air conditioning apparatus 10 performs second control using the second injection flow path 67 when the outside air temperature detected by the outside air temperature sensor 95 is higher than the threshold value. In this second control, the control unit 90 opens the second opening and closing valve 68 of the second injection flow path 67, closes the first opening and closing valve 66 of the first injection flow path 65, and adjusts the opening degree of the injection-use electrically powered valve 63 to inject, into the third pipe 27*c* connected to the suction portion of the compressor 20, the refrigerant that has been diverted from the main refrigerant flow path 11*a* and traveled through the injection-use heat exchanger 64. At this time, the injection-use heat exchanger 64 fulfills the role of subcooling the refrigerant traveling through the main refrigerant flow path 11*a*, and the refrigerant that has been diverted from the main refrigerant flow path 11*a* flows into the third pipe 27*c* of the suction flow path 27 and not the accumulator 70, so foaming is kept from occurring inside the accumulator 70. Because the outside air temperature is higher than the threshold value, the two layer separation phenomenon does not occur inside the accumulator 70.

Furthermore, the control unit 90 of the air conditioning apparatus 10 switches to the second control using the second injection flow path 67, even in a state in which it is performing the first control using the first injection flow path 65, when the discharge temperature of the compressor 20 exceeds an upper limit value and it is necessary to control the discharge temperature even though it is not necessary to immediately stop the compressor 20. At this time, the control unit 90 performs injection control by adjusting the opening degree of the injection-use electrically powered valve 63 in such a way that the refrigerant in a wet state flows from the injection-use heat exchanger 64 via the third pipe 27*c* into the compressor 20, to thereby lower the discharge temperature of the compressor 20.

(4) Characteristics of Air Conditioning Apparatus (4-1)

In the air conditioning apparatus 10 pertaining to the present embodiment, R32 is used as the refrigerant, and the accumulator 70 that has the function of accumulating surplus refrigerant is disposed in the suction flow path 27, so at the time of a low temperature condition it may be assumed that the liquid refrigerant and the refrigerating machine oil will separate into two layers in the inside space IS of the accumulator 70. However, here, the air conditioning apparatus 10 is configured in such a way that the refrigerant flowing through the branching pipe 62 that branches from the main refrigerant flow path 11*a* is guided via the injection-use heat exchanger 64 from the first injection flow path 65 to the inside space IS of the accumulator 70, and the distal end opening 65*a* in the first injection flow path 65 is disposed in a height position near the bottom of the inside space IS of the accumulator 70. For this reason, the liquid refrigerant and the refrigerating machine oil that accumulate in the inside space IS of the accumulator 70 can be agitated by the refrigerant entering the accumulator 70 from the first injection flow path 65. Because of this, the separation phenomenon can be controlled by the agitation even at the time of a low temperature condition where it seems likely that the liquid refrigerant and the refrigerating machine oil will separate into two layers in the inside space IS of the accumulator 70 as shown in FIG. 3.

(4-2)

In the air conditioning apparatus 10 pertaining to the present embodiment, the distal end opening 65*a* in the first injection flow path 65 is positioned in a place lower than the height position of the upper end 71*d* of the lower cover 71*c* among the parts configuring the casing 71 of the accumulator 70. For this reason, as shown in FIG. .4, the liquid refrigerant and the refrigerating machine oil that accumulate in the inside space IS of the accumulator 70 can be effectively agitated.

(4-3)

In the air conditioning apparatus 10 pertaining to the present embodiment, the second injection flow path 67 is disposed in addition to the first injection flow path 65, and the switching mechanism (the first opening and closing valve 66 and the second opening and closing valve 68) switches between which of the injection flow paths 65 and 67 to use to return the refrigerant that has exited the injection-use heat exchanger 64 to the suction flow path 27. For this reason, when it seems likely that the liquid refrigerant and the refrigerating machine oil will separate into two layers in the inside space IS of the accumulator 70 as shown in FIG. 3, the first injection flow path 65 is used to return the refrigerant to the compressor 20 via the accumulator 70 and the second and third pipes 27*b* and 27*c* of the suction flow path 27, and when it does not seem likely that the liquid refrigerant and the refrigerating machine oil will separate into two layers in the inside space IS of the accumulator 70, the second injection flow path 67 is used to return the refrigerant to the compressor 20 via the third pipe 27*c* of the suction flow path 27, and thus foaming in the inside space IS of the accumulator 70 can be controlled. Specifically, when the outside air temperature is equal to or lower than the threshold value, which is a condition where the temperature of the refrigerant drops, the control unit 90 performs the first control using the first injection flow path 65, and when the outside air temperature detected by the outside air temperature sensor 95 is higher than the threshold value, the control unit 90 performs the second control using the second injection flow path 67.

Furthermore, at the time of a situation where the discharge temperature of the compressor 20 has exceeded an upper limit value and reached a high temperature, the second injection flow path 67, and not the first injection flow path 65, is used to directly return the refrigerant from the injection-use heat exchanger 64 to the third pipe 27*c* of the suction flow path 27 near the compressor 20, and thus the effect of cooling the compressor 20 can be obtained early on.

(4-4)

In the air conditioning apparatus 10 pertaining to the present embodiment, the distal end opening 65*a* in the first injection flow path 65 faces the direction along the inside surface 71*e* of the accumulator 70. For this reason, the refrigerant entering the inside space IS of the accumulator 70 from the first injection flow path 65 flows along the inside surface 71*e* of the accumulator 70, and foaming is kept relatively small.

Figure 4:
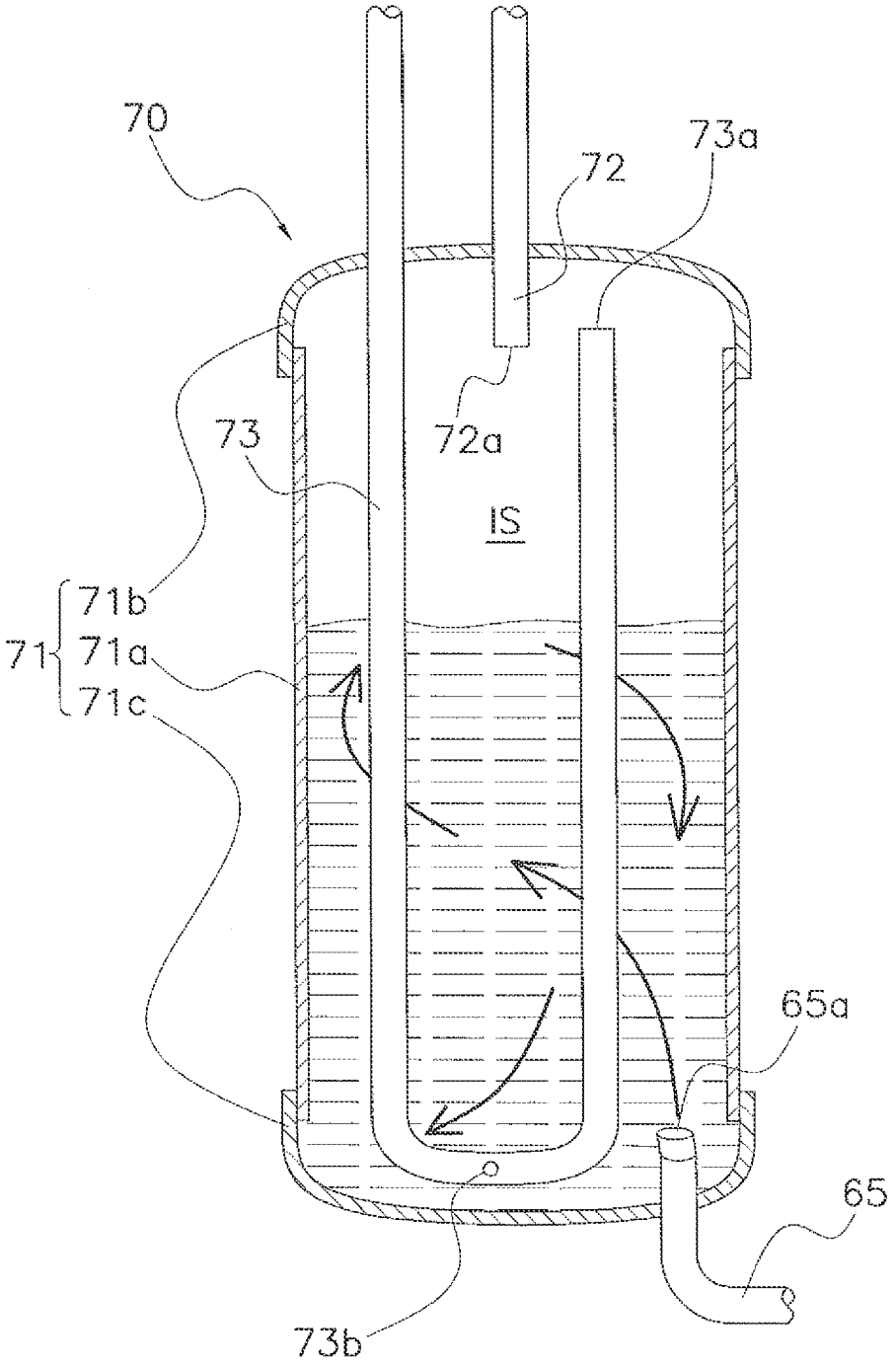
FIG 4 is a drawing showing the accumulator, with the inside space being agitated by refrigerant from a first injection flow path.

Furthermore, in the air conditioning apparatus 10, the distal end opening 65*a* in the first injection flow path 65 faces diagonally upward. For this reason, the refrigerant entering the inside space IS of the accumulator 70 from the first injection flow path 65 has an upward vector, so it becomes difficult for the liquid refrigerant and the refrigerant machine oil in the inside space IS of the accumulator 70 that try to separate into two vertical layers to separate. That is, the refrigerant entering the inside space IS of the accumulator 70 from the injection-use heat exchanger 64 creates a vertical flow in the inside space IS of the accumulator 70 as shown in FIG. 4, so it becomes even more difficult for two layer separation between the liquid refrigerant and the refrigerating machine oil to occur even at a low temperature.

(5) Example Modification

Figure 5:
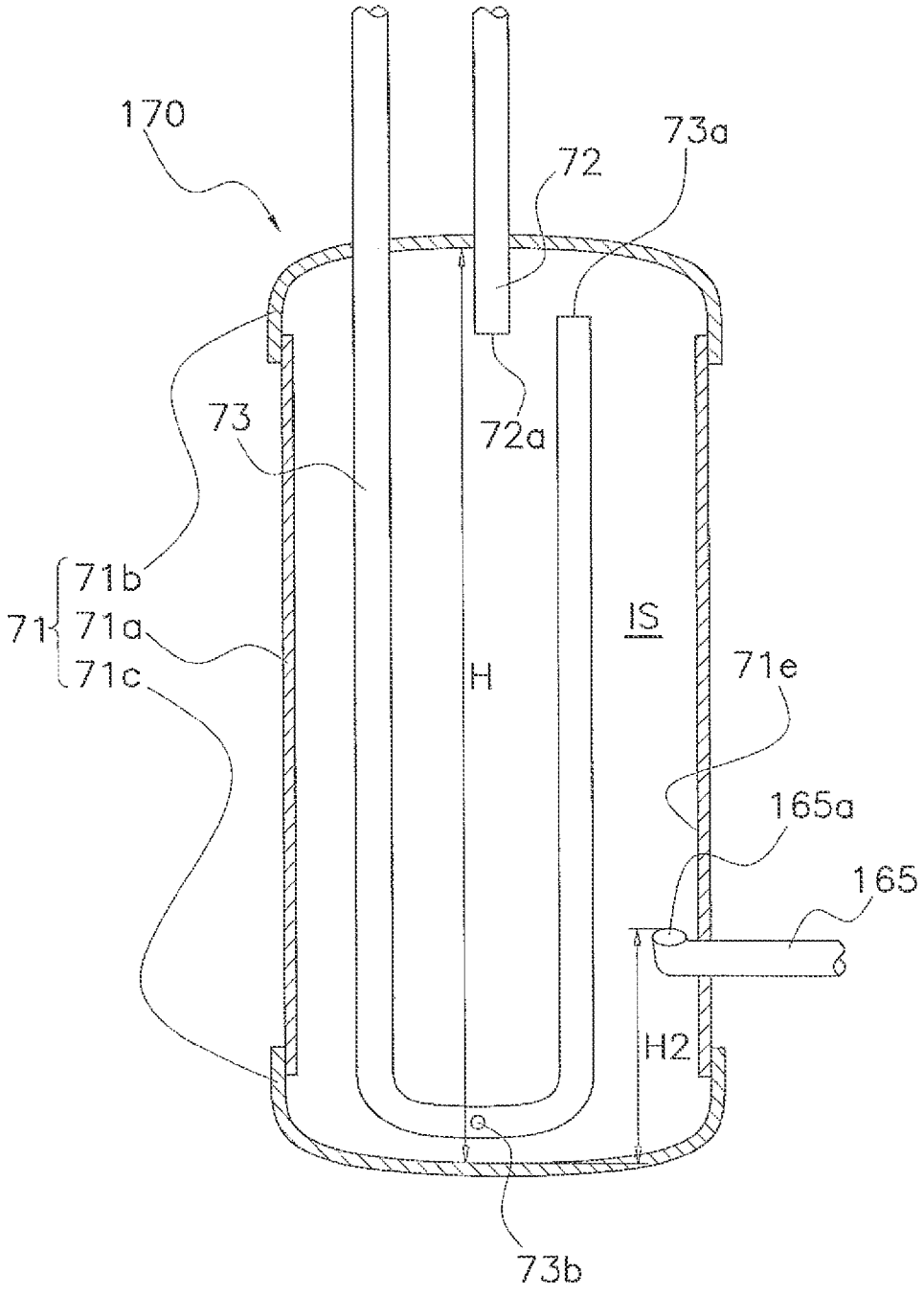
FIG. 5 is a schematic configuration drawing of an accumulator pertaining to an example modification.

In the above-described embodiment, as shown in FIG. 2, the distal end section of the first injection flow path 65 penetrates the lower cover 71*c* of the accumulator 70 from below to above, but a configuration such as shown in FIG. 5 may also be employed. In FIG. 5, a distal end section 165 of the first injection flow path 65 penetrates the cylindrical body 71*a* of the accumulator 70 from outward to inward. Additionally, a distal end opening 165*a* in the distal end section 165 of the first injection flow path 65 faces diagonally upward along the inside surface 71*e* of the accumulator 70. The distal end opening 165*a* is located in a position separated by a height dimension H2 from the bottom of the inside space IS of the accumulator 70. The height dimension H2 is 0 to 0.3 times the height dimension H of the inside space IS of the accumulator 70. In what is shown in FIG. 5, the height dimension H2 is equal to or less than ¼ of the height dimension H.

The first injection flow path 65, in which is formed the distal end opening 165*a* that faces diagonally upward at this height position and injects the refrigerant, also effectively agitates the liquid refrigerant and the refrigerating machine oil that accumulate in the inside space IS of the accumulator 70 like in the above-described embodiment, so that the separation phenomenon can be controlled by the agitation even at the time of a low temperature condition when it seems likely that the liquid refrigerant and the refrigerating machine oil will separate into two layers in the inside space IS of the accumulator 70.

What is claimed is:

1. A refrigeration apparatus that uses R32 as a refrigerant, the refrigeration apparatus comprising:

a compressor arranged and configured to suck in the refrigerant from a suction flow path and compress the refrigerant;

a condenser arranged and configured to condense the refrigerant that has been discharged from the compressor;

an expansion mechanism arranged and configured to expand the refrigerant that has exited the condenser;

an evaporator arranged and configured to evaporate the refrigerant that has expanded in the expansion mechanism;

an accumulator disposed in the suction flow path, the accumulator having an inside space formed therein that is arranged and configured to separate the refrigerant that has exited the evaporator into gas refrigerant and liquid refrigerant and to accumulate surplus refrigerant, and sending the separated gas refrigerant to the compressor;

a branching flow path branching from a main refrigerant flow path interconnecting the condenser and the evaporator;

an opening degree adjustment valve disposed in the branching flow path and having an opening degree that can be adjusted;

an injection-use heat exchanger arranged and configured to cause the refrigerant flowing through the main refrigerant flow path and the refrigerant that has passed through the opening degree adjustment valve of the branching flow path to exchange heat;

a first injection flow path guiding the refrigerant that has flowed through the branching flow path and exited the injection-use heat exchanger to the inside space of the accumulator, with a distal end of the first injection flow path being located in a height position separated by a dimension from a bottom of the inside space, and the dimension being 0 to 0.3 times a height dimension of the inside space;

a second injection flow path guiding the refrigerant that has flowed through the branching flow path and exited the injection-use heat exchanger to the suction flow path between the accumulator and the compressor; and a switching mechanism arranged and configured to switch between a first state in which the refrigerant that has flowed through the branching flow path and exited the injection-use heat exchanger flows into the inside space of the accumulator and a second state in which the refrigerant that has flowed through the branching flow path and exited the injection-use heat exchanger flows into the suction flow path between the accumulator and the compressor.

2. The refrigeration apparatus according to claim 1, further comprising a control unit performing;

a first control that switches the switching mechanism to the first state when the outside air temperature is equal to or lower than a threshold value, and a second control that switches the switching mechanism to the second state when the outside air temperature exceeds the threshold value.

3. The refrigeration apparatus according to claim 1, wherein a refrigerant outlet in the distal end of the first injection flow path faces in a direction extending along an inside surface of the accumulator.

4. The refrigeration apparatus according to claim 1, wherein a refrigerant outlet in the distal end of the first injection flow path faces upward or diagonally upward.

5. The refrigeration apparatus according to claim 1, wherein the accumulator has a casing forming the inside space, an inlet pipe arranged and configured to feed the refrigerant that has evaporated in the evaporator to the inside space, and an outlet pipe arranged and configured to channel the separated gas refrigerant to the compressor, the casing includes a tubular body having an open top and an open bottom, an upper cover closing off the open top of the tubular body, and a lower cover closing off the open bottom of the tubular body, and the height position of the distal end of the first injection flow path is lower than a height position of an upper end of the lower cover.

6. The refrigeration apparatus according to claim 2, wherein a refrigerant outlet in the distal end of the first injection flow path faces in a direction extending along an inside surface of the accumulator.

7. The refrigeration apparatus according to claim 2, wherein a refrigerant outlet in the distal end of the first injection flow path faces upward or diagonally upward.

8. The refrigeration apparatus according to claim 2, wherein the accumulator has a casing forming the inside space, an inlet pipe arranged and configured to feed the refrigerant that has evaporated in the evaporator to the inside space, and an outlet pipe arranged and configured to channel the separated gas refrigerant to the compressor, the casing includes a tubular body having an open top and an open bottom, an upper cover closing off the open top of the tubular body, and a lower cover closing off the open bottom of the tubular body, and the height position of the distal end of the first injection flow path is lower than a height position of an upper end of the lower cover.

9. The refrigeration apparatus according to claim 3, wherein the accumulator has a casing forming the inside space, an inlet pipe arranged and configured to feed the refrigerant that has evaporated in the evaporator to the inside space, and an outlet pipe arranged and configured to channel the separated gas refrigerant to the compressor, the casing includes a tubular body having an open top and an open bottom, an upper cover closing off the open top of the tubular body, and a lower cover closing off the open bottom of the tubular body, and the height position of the distal end of the first injection flow path is lower than a height position of an upper end of the lower cover.

10. The refrigeration apparatus according to claim 4, wherein the accumulator has a casing forming the inside space, an inlet pipe arranged and configured to feed the refrigerant that has evaporated in the evaporator to the inside space, and an outlet pipe arranged and configured to channel the separated gas refrigerant to the compressor, the casing includes a tubular body having an open top and an open bottom, an upper cover closing off the open top of the tubular body, and a lower cover closing off the open bottom of the tubular body, and the height position of the distal end of the first injection flow path is lower than a height position of an upper end of the lower cover.

* * * * *